US007984667B2

(12) United States Patent
Freudinger

(10) Patent No.: US 7,984,667 B2
(45) Date of Patent: Jul. 26, 2011

(54) PIZZA CUTTING APPARATUS

(75) Inventor: Mark J. Freudinger, Peotone, IL (US)

(73) Assignee: Quantum Technical Services Inc., Frankfort, IL (US)

( * ) Notice: Subject to any disclaimer, the term of this patent is extended or adjusted under 35 U.S.C. 154(b) by 1174 days.

(21) Appl. No.: 11/388,713

(22) Filed: Mar. 24, 2006

(65) Prior Publication Data

US 2007/0221029 A1 Sep. 27, 2007

(51) Int. Cl.

| | |
|---|---|
| ***B26D 1/09*** | (2006.01) |
| ***B26D 3/24*** | (2006.01) |
| ***B26D 5/08*** | (2006.01) |
| ***B26D 7/26*** | (2006.01) |

(52) U.S. Cl. ..... 83/620; 83/588; 83/629; 83/636; 83/644; 83/646; 83/697; 83/698.71; 83/932; 30/114; 30/303

(58) Field of Classification Search ..... 83/620–622, 83/694, 695, 698.71, 699.11, 582, 586–588, 83/618, 627, 629, 633, 636, 646, 697, 932, 83/953; 30/114, 302–305, 315, 316, 130, 30/280, 281, 294, 301, 314; 99/537; 100/97, 100/98 R; 425/289

See application file for complete search history.

(56) References Cited

U.S. PATENT DOCUMENTS

| | | | | | |
|---|---|---|---|---|---|
| 880,057 | A | * | 2/1908 | Wheeler | 83/588 |
| 1,250,676 | A | * | 12/1917 | Segerc | 30/302 |
| 1,453,367 | A | * | 5/1923 | Schipplock et al. | 30/114 |
| 1,581,310 | A | * | 4/1926 | Fetschan | 30/303 |
| 1,610,322 | A | * | 12/1926 | Reich | 241/272 |
| 2,003,253 | A | * | 5/1935 | Deutsch | 30/114 |
| 2,373,781 | A | * | 4/1945 | Richardson | 452/141 |
| 3,132,423 | A | * | 5/1964 | DeLano | 30/114 |
| D206,279 | S | * | 11/1966 | Palmer | D7/673 |
| 3,810,308 | A | * | 5/1974 | Stubbmann | 30/130 |
| 4,072,075 | A | * | 2/1978 | Ezaki | 83/153 |
| 4,250,618 | A | * | 2/1981 | Custer et al. | 30/114 |
| 5,018,419 | A | * | 5/1991 | Omura | 83/451 |

(Continued)

FOREIGN PATENT DOCUMENTS

CH 675 390 * 9/1990

(Continued)

OTHER PUBLICATIONS

Photo advertisement, (1 photo).

(Continued)

*Primary Examiner* — Clark F. Dexter
(74) *Attorney, Agent, or Firm* — Jones Day

(57) ABSTRACT

A pizza cutting apparatus and portions of the apparatus, and methods of forming the apparatus and of disassembly. The apparatus includes a simple frame assembly made from sheet metal, an actuator assembly and a cutting assembly. The cutting assembly includes a central hub, a number of attached blade and guard combinations, a shaft with a flange and an elastic band. Each blade includes two spaced apart openings, one to receive the flange and the other to be engaged by the band so as to restrain the blades mounted in the hub. Each guard includes perforations for easy gripping by an operator. A blade is removed by having the operator safely grip each guard to stretch the band so as to disengage the blade from the flange and then return and rotate the blade to disengage the blade from the band.

17 Claims, 9 Drawing Sheets

U.S. PATENT DOCUMENTS

| | | | | |
|---|---|---|---|---|
| 5,165,942 | A | 11/1992 | Wadell | |
| 5,446,965 | A * | 9/1995 | Makridis | 30/303 |
| 5,873,294 | A * | 2/1999 | Sciuto | 83/588 |
| 5,896,796 | A * | 4/1999 | Chih | 83/181 |
| 6,557,260 | B1 * | 5/2003 | Morris | 30/114 |
| 7,480,999 | B2 * | 1/2009 | Atwater et al. | 30/289 |
| 7,568,414 | B2 * | 8/2009 | Farid et al. | 83/435.19 |
| 2004/0020055 | A1 * | 2/2004 | Zuker | 30/114 |
| 2006/0272466 | A1 * | 12/2006 | Atwater et al. | 83/620 |

FOREIGN PATENT DOCUMENTS

| | | | |
|---|---|---|---|
| FR | 2 885 314 | * | 11/2006 |

OTHER PUBLICATIONS

Pizzamatic Corporation, drawings advertisement, (4 drawings).

* cited by examiner 22
10
12
16
1
354
18
14
382
396
392
20
380
394
390

10

20
12
22
14
18

24

22
16
12
10
354
18
20
14

22
10
16
12
18
20
14

85
67
54
36
86
89
16
50
38
48
88
34
87
46
60
44
12
49
19
62

16
36
48
42
46
69
40
38
71
12
32
73
75

16
98
42
105
99
69
100
32
110
54
108
50
36
48
67
34
58
83
81
38
142
93
97
71
56
44
107
52
22
30
70
106
30
73
64
75
12
61
40

PIZZA CUTTING APPARATUS

CROSS REFERENCE TO PRIORITY APPLICATIONS

Not applicable.

STATEMENT REGARDING FEDERALLY SPONSORED RESEARCH

Not applicable.

BACKGROUND OF THE INVENTION

1. Field of the Invention

The present invention relates to a pizza cutting apparatus and more particularly to a pizza cutting apparatus, its assemblies and related methods, the pizza cutting apparatus being simply constructed, elegantly designed and easily disassembled for cleaning and blade changing.

2. Description of the Related Art

Pizza cutting devices are known and include specially-designed knives having rounded cutting blades, devices having multiple blades mounted in a round frame and machines that slice pizza using a mechanical advantage.

One such machine has a cast aluminum frame, a cutting assembly and a rack and pinion gear drive operated by a pivotal handle. The cutting assembly includes multiple blades connected to a hub surrounded by a protective grill. However, the cutting assembly is difficult to disassemble. Each blade includes an attached pin which is inserted into the hub, and the arrangement requires the connected cutting assembly to be inverted during disassembly. When inverted the cutting edges of the blades are exposed. Thereafter, troublesome manipulation is required to remove the individual blades for cleaning or alteration.

BRIEF SUMMARY OF THE INVENTION

The difficulties encountered with these previous devices and machines have been overcome by the present invention. What is described here is a pizza cutting apparatus including a frame, an actuator assembly, and a cutting assembly. The cutting assembly includes a plurality of cutting blades, a central hub for mounting the blades, a first connector and a second connector, each of the cutting blades having a first opening for receiving the first connector and a second opening for receiving the second connector.

The invention also includes a simple but elegant frame structure, a method of forming the frame structure, and a method of disassembling the pizza cutting apparatus.

An understanding of the present invention and features, advantages and objects thereof will be gained from a consideration of the present specification which provides a written description of the invention, and of the manner and process of making and using the invention, set forth in such full, clear, concise, and exact terms as to enable any person skilled in the art to which it pertains, or with which it is more nearly connected, to make and use the same in compliance with Title 35 U.S.C. §112 ($1^{st}$ paragraph). Furthermore, the following description of a preferred embodiment of the invention read in conjunction with the accompanying drawing provided herein, represents an example of the invention also in compliance with Title 35 U.S.C. §112 ($1^{st}$ paragraph), but the invention itself is defined in the Claims section attached hereto.

DETAILED DESCRIPTION OF A PREFERRED EMBODIMENT OF THE INVENTION

Figure 1:
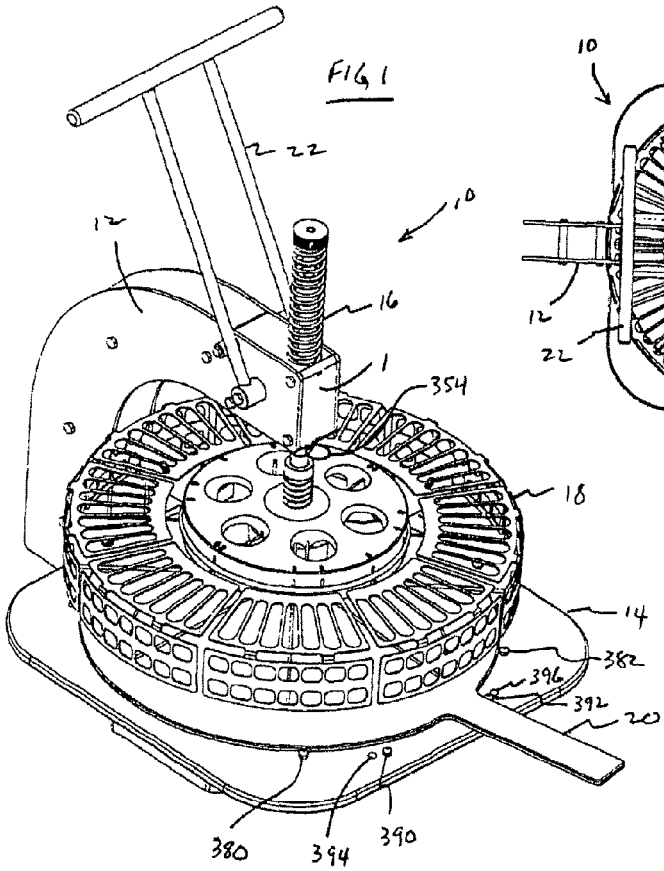
FIG. 1 is a front looking isometric view of a pizza cutting apparatus.
Figure 4:
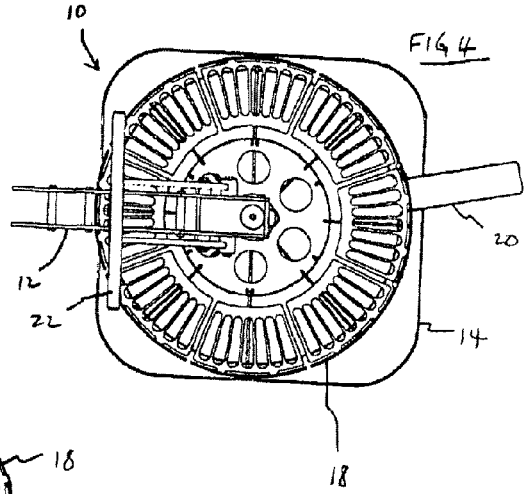
FIG. 4 is a top plan view of the pizza cutting apparatus.
Figure 2:
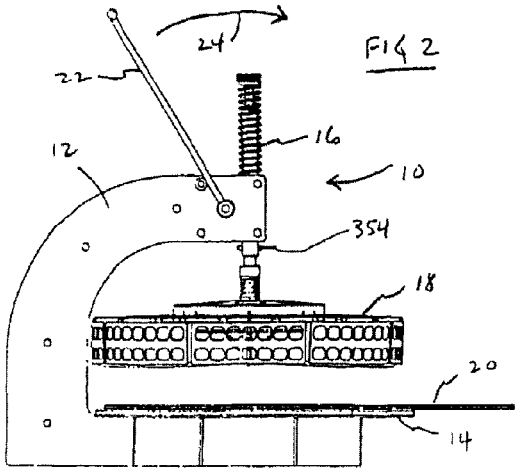
FIG. 2 is a side elevation view of the pizza cutting apparatus.
Figure 3:
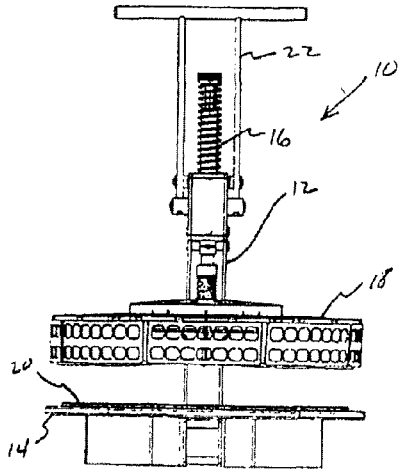
FIG. 3 is a front elevation view of the pizza cutting apparatus.

While the present invention is open to various modifications and alternative constructions, the preferred embodiment illustrating the best mode contemplated by the inventor of carrying out his invention is shown in the various figures of the drawing and will be described herein in detail, pursuant to Title 35 U.S.C. §112 ($1^{st}$ paragraph). It is understood, however, that there is no intention to limit the invention to the particular embodiment or example which is disclosed herein. To the contrary, the intention is to cover all modifications, equivalent structures and methods, and alternative constructions falling within the spirit and scope of the invention as expressed and defined in the appended Claims section attached hereto, pursuant to Title 35 U.S.C. §112 ($2^{nd}$ paragraph).

The assembled pizza cutting apparatus 10 is shown in FIGS. 1-4. The pizza cutting apparatus 10 includes a frame assembly 12, a support plate 14 mounted to the frame assembly 12, an actuator assembly 16 mounted to the frame assembly and a cutting assembly 18 connected to the actuator assembly. The pizza cutting apparatus 10 is designed in a compact configuration to enable the apparatus to be located on a countertop (not shown) and receive a pizza peel 20 placed under the cutting assembly 18. To cut the pizza, an operator simply grips a lever or handle 22 of the actuator assembly 16, using one or two hands, and rotates the lever to the right as shown by the arrow 24 in FIG. 2. Rotation of the lever causes the cutting assembly 18 to move downwardly toward the pizza peel 20 and a pizza (not shown) located on the pizza peel.

Figure 7:
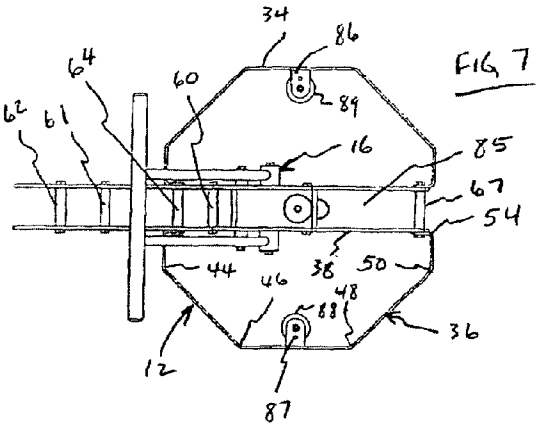
FIG. 7 is a top plan view of the frame and actuator assemblies.
Figure 6:
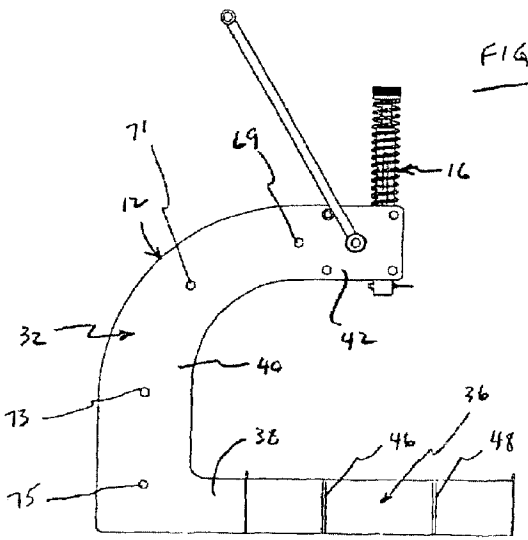
FIG. 6 is a side elevation view of the frame and actuator assemblies.

Referring now to FIGS. 5-8 the various features of the frame assembly are detailed. The frame assembly includes two generally C-shaped plate members 30, 32 and two bent strip members 34, 36. Each of the C-shaped members includes a lower base portion, a middle neck portion and an upper actuator support portion, such as the lower base portion 38, the middle neck portion 40, and the upper actuator support portion 42 of the C-shaped member 32. Each C-shaped member may be cut from metal sheet stock having a thickness of about 0.1874 inches. The same metal sheet stock may also be used to provide the two strip members. The C-shaped and strip members may then be drilled to enable the receipt of fasteners. The strip members may each be bent in four locations, such as bends 44, 46, 48, 50 of the strip member 36. When the bent strip members are connected to the C-shaped members, a generally octagon-shaped base portion is formed as shown in FIG. 7. Connection of the strip members to the C-shaped members may be facilitated by two further bends, such as bends 52, 54 forming opposing arms 56, 58 on the strip member 36.

Eight threaded spacers 60, 61, 62, 63, 64, 66, 67, 68 and sixteen threaded fasteners 69, 70 71, 72, 73, 74, 75, 76, 77, 78, 79, 80, 81, 82, 83, 84 (spacer 60 and fasteners 69, 70 are not shown in FIG. 8 for clarity) connect the two C-shaped members in a spaced apart relationship. Four of the spacers 64, 66, 67, 68 and eight of the fasteners 77, 78, 79, 80, 81, 82, 83, 84 may also be used to connect the bent strip members 34, 36 to the C-shaped members 30, 32 so as to form the stable, generally equilateral, octagon-shaped base. A feature and advantage of the octagon-shaped base is that it is very stable and the base portions 38 of the C-shaped members 30, 32 not only enhance stability but also provide strength and middle support in the region designated 85 in FIG. 7, the interior of the octagon-shaped configuration.

A pair of lateral tabs 86, 87 supporting suction cups 89, 88 are attached to the strip members 34, 36 and further enhance stability as well as prevent movement of the apparatus should the countertop be very smooth and/or wet.

The actuator assembly 16 for the pizza cutting apparatus 10 may include the lever 22, a plunger 90, a pinion 91 and a rack 92, the rack being integrally formed as part of the plunger. The plunger and pinion are mounted in a plastic housing or block 93 which supports the plunger. The plunger is biased upwardly with a coil spring 94. A tension knob 96 is used to adjust the tension of the spring 94 such that the weight of the cutting assembly 18 may be balanced. Four fasteners 97, 98, 99, 100 may be used to connect the actuator assembly 16 to the C-shaped frame member 32 and four fasteners 101, 102, 103, 104 may be used to connect the actuator assembly to the C-shaped frame member 30. The housing 93 also acts as a spacer between the two C-shaped frame members 30, 32. Two fasteners 97, 101 may be elongated to support two spacers 105, 106 which act as a rest or stop for the lever 22.

Four tabs 107, 108, 109, 110 may be formed on the strip members 34, 36 and are used to locate and restrain the plate 14 on the frame assembly 12.

The C-shaped members 30, 32, the strip members 34, 36, the fasteners and the spacers as well as the lever 22, the spring 94, the knob 96 and the plunger 90 may all be formed of stainless steel. The use of stainless steel rather than an aluminum casting has the advantage in that the stainless steel does not absorb food matter as does a porous aluminum casting. The structure of the frame assembly is simple, elegant and relatively inexpensive and allows the frame to be easily manufactured and assembled. The frame assembly is also easily cleaned by submerging the whole assembly into a sink of soapy water or by wiping the frame assembly with a cloth.

The plate 14 and the housing 93 may be formed of a suitable plastic such as polypropylene. These are also easily cleaned.

It is noted that the specific shape of the C-shaped members may be varied and yet still function in the same manner. The same is true of the octagon shape of the frame base portion. The strip members may be formed in a variety of different geometric figures, such as generally, a hexagon, a circle or an oval. Any suitable geometric shape that will provide the desired stability and strength for the pizza cutting apparatus may be used; however, a Y-shaped base used previously does not exhibit sufficient stability.

Figure 5:
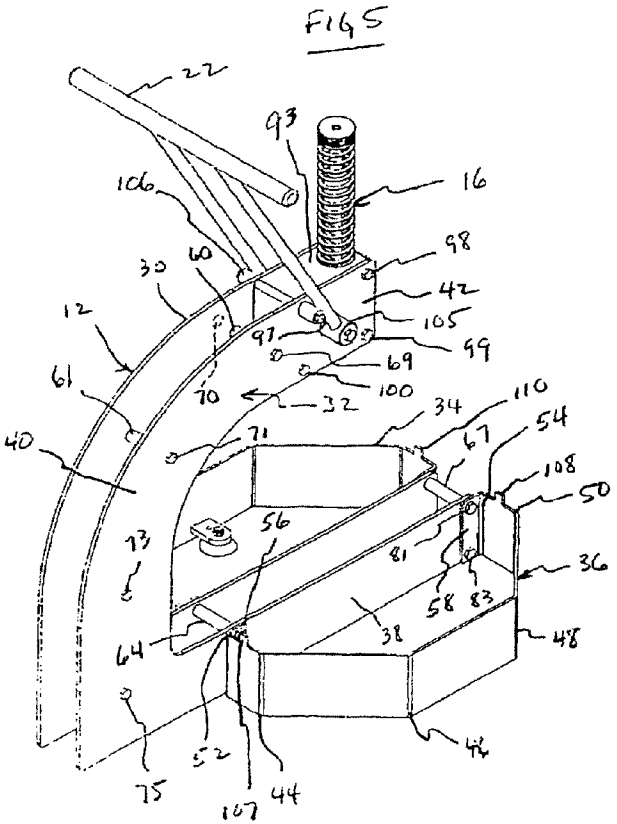
FIG. 5 is a rear looking isometric view of a frame assembly and an actuator assembly of the pizza cutting apparatus illustrated in FIGS. 1-4.
Figure 8:
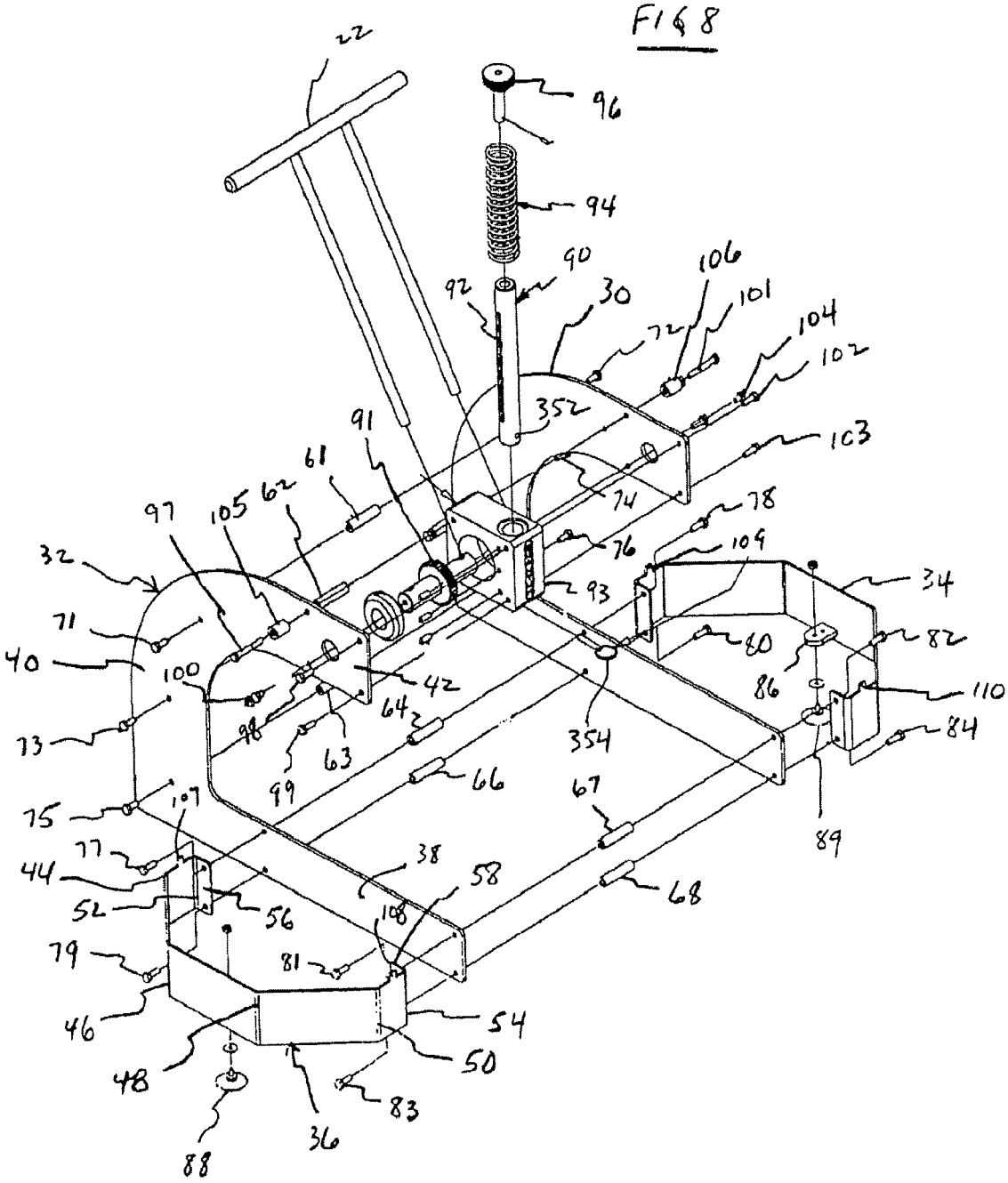
FIG. 8 is an exploded isometric view of the frame and actuator assemblies.
Figure 9:
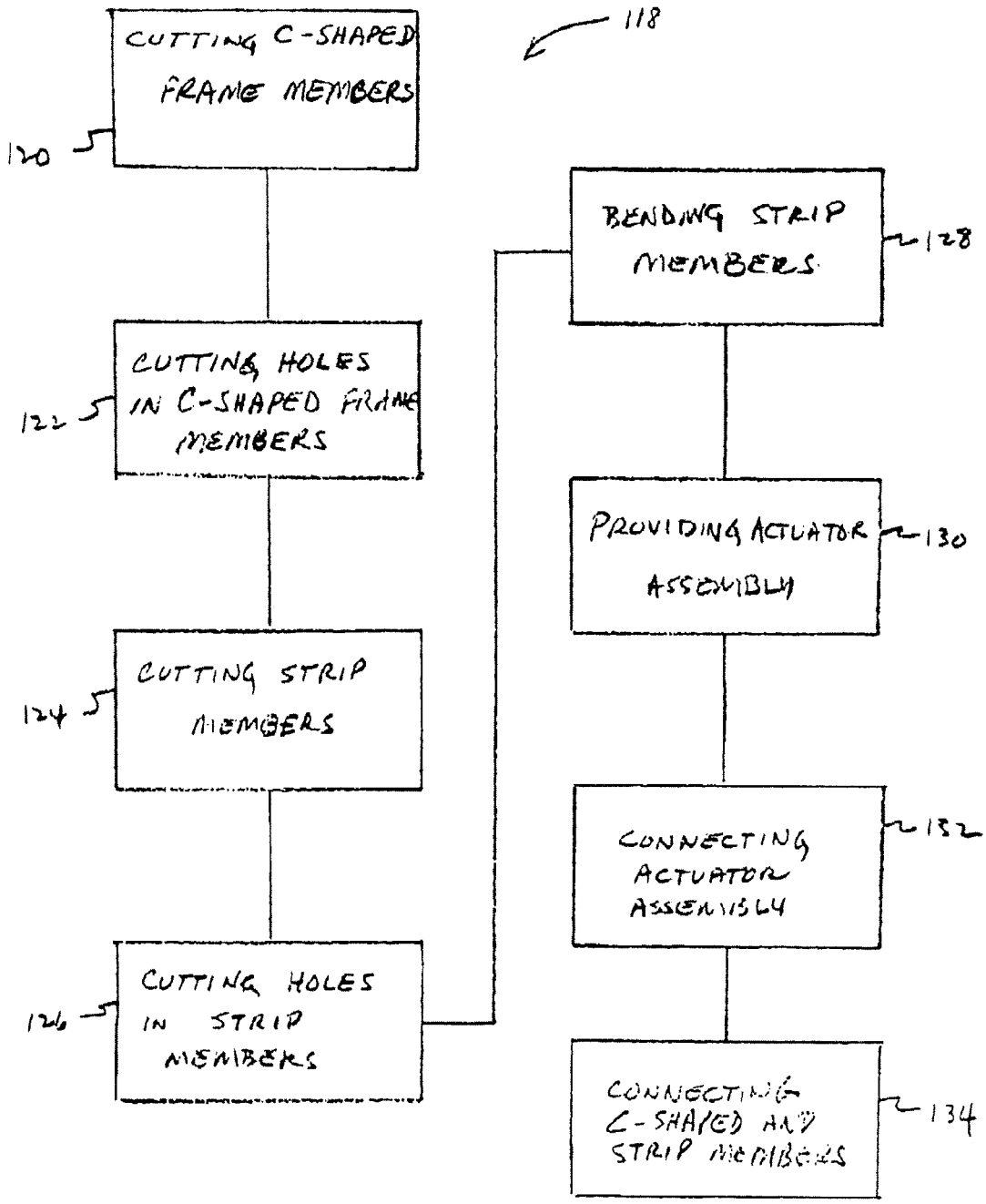
FIG. 9 is a flow chart illustrating a method of forming the frame and actuator assemblies.

The method 118 of forming frame assembly may be accomplished quite easily as depicted in FIG. 9 by cutting 120 the C-shaped members from sheet metal stock , such as by a laser, also cutting 122 holes for the fasteners, cutting 124 the strip members from sheet metal stock, also cutting 126 appropriate fastener holes, bending 128 the strip members into a desired geometric shape, providing 130 the actuator assembly, and connecting 132, 134 the C-shaped members, the bent strip members and the actuator assembly to form the structure such as that shown in FIG. 5.

The cutting assembly 18 is shown in greater detail in FIGS. 10-20. The cutting assembly 18, FIGS. 10-12, includes a central hub 140, a plurality of cutting blades, eight blades 142, 144, 146, 148, 150, 152, 154, 156 being shown, a plurality of blade guards 158, 160, 162, 164, 166, 168, 170, 172, one blade guard for each of the cutting blades, a shaft 174 with a connector in the form of a disc-shaped flange 176, and an integral washer 177, a compression spring 178, a collar 180 and another connector in the form of an elastic band 182.

Figure 13:
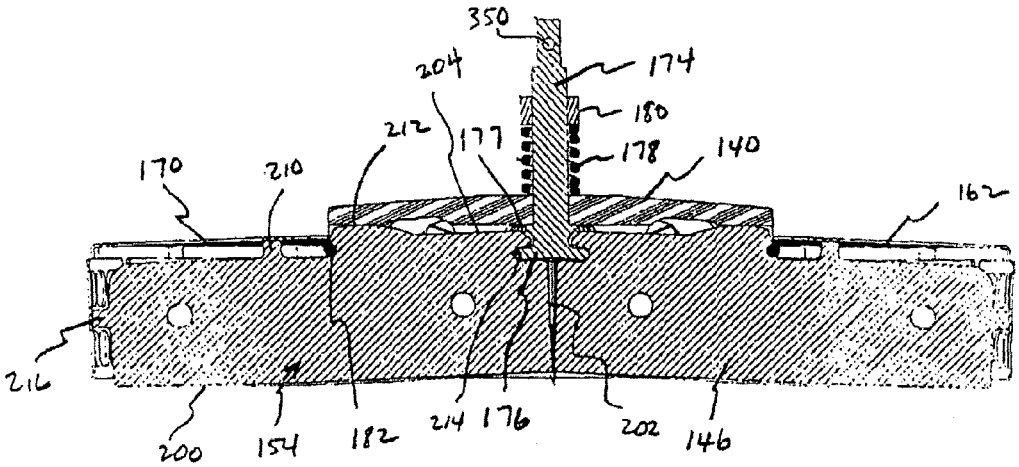
FIG. 13 is a sectional view taken along line 13-13 of FIG. 12.
Figure 14:
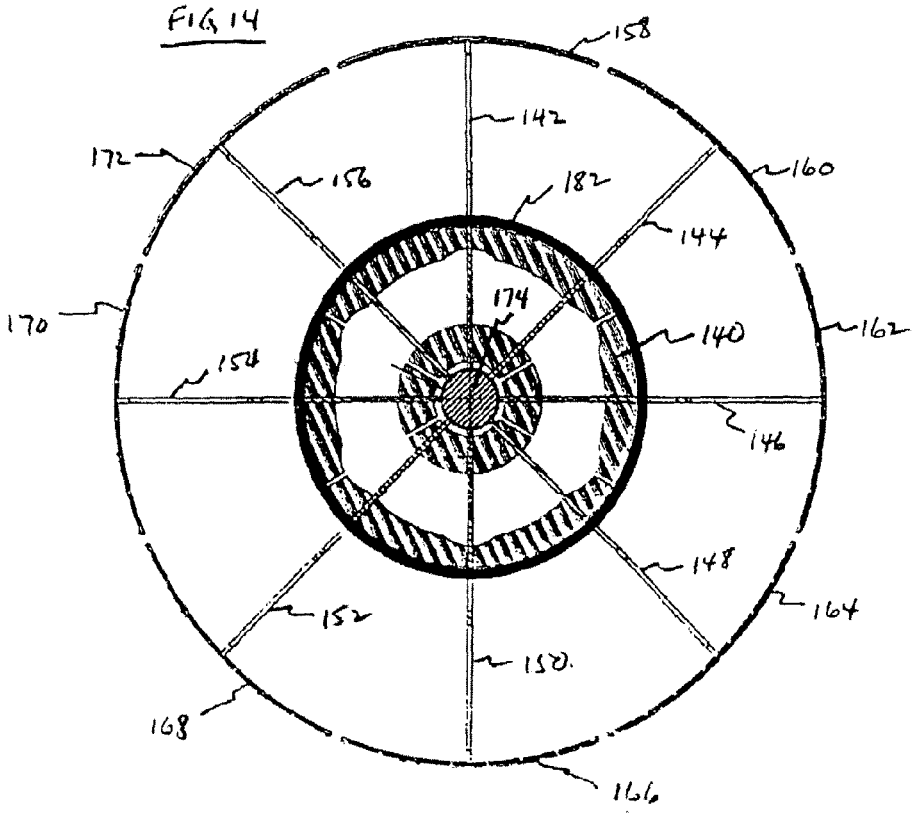
FIG. 14 is a sectional view taken along line 14-14 of FIG. 11.
Figure 17:
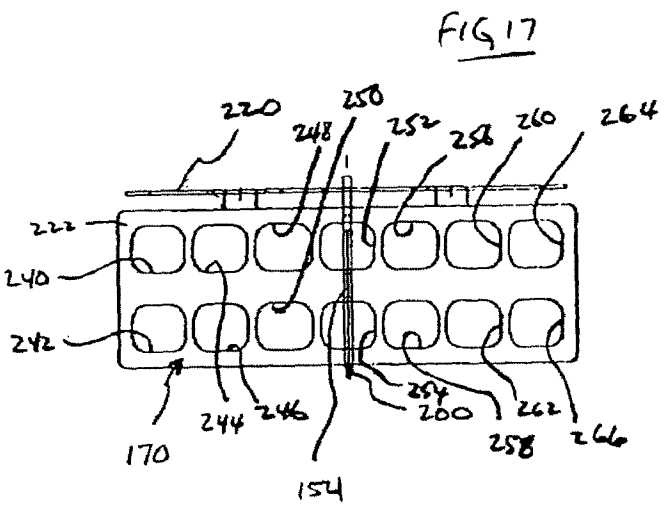
FIG. 17 is a front elevation view of the blade and guard combination.
Figure 15:
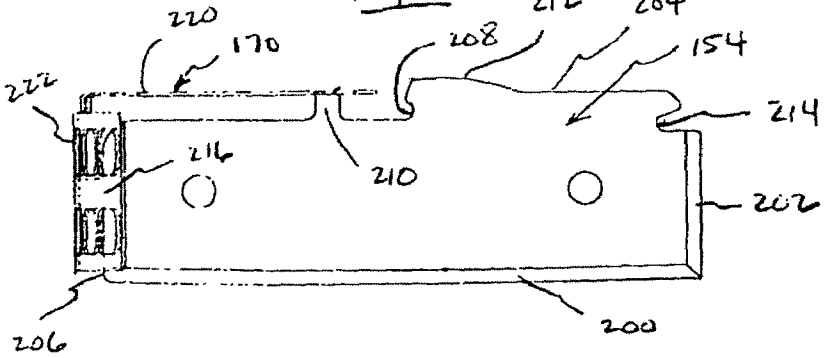
FIG. 15 is a side elevation view of a cutting blade and blade guard combination of the cutting assembly.
Figure 16:
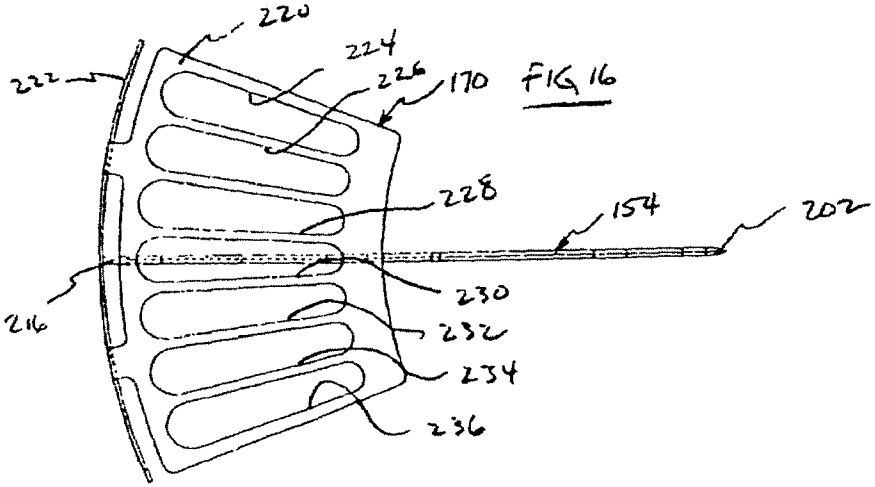
FIG. 16 is a top plan view of the blade and guard combination.

As shown in FIGS. 13 and 15, each cutting blade, such as the cutting blade 154, is formed from a plate of stainless steel with a beveled lower cutting edge 200 and a beveled inner edge 202. Each cutting blade also includes an upper edge 204, and an outer side edge 206. Formed in the upper edge 204 is a first or outer opening 208, an upper tab 210 and a curved top surface 212. Formed above the beveled inner edge 202, and spaced from the first opening, is a second or inner side opening 214 and formed on the outer side edge 206 is a side tab 216.

Each blade guard, such as the blade guard 170 has an horizontal upper portion 220 and a vertical side portion 222. The upper and side portions 220, 222 are formed of sheet stainless steel, about 0.063 inches thick, and are perforated. The upper portion 220 has perforations in the form of seven slots 224, 226, 228, 230, 232, 234, 236. The side portion 222 has perforations in the form of a series of fourteen aligned rectangles 240, 242, 244, 246, 248, 250, 252, 254, 256, 258, 260, 262, 264, 266. Another feature of the pizza cutting apparatus is that the perforations allow the blade guards to be easily gripped by the fingers of an operator's hand. The blade guard 170 may be attached to the cutting blade 154 by welding the upper portion 220 of the blade guard to the upper tab 210 of the cutting blade, and welding the side portion 222 of the blade guard to the side tab 216 of the cutting blade. It is noted that other geometric shapes may be used for the perforations.

The beveled lower edge 200 of each cutting blade is formed with a large radius so as to be curved when viewed in elevation, as shown in FIG. 13. The beveled inner side edge 202 enables the eight blades to adjoin each other in a very close arrangement, as also illustrated in FIG. 13.

The curved surface 212 of the upper edge 204 of each cutting blade functions to rotate the cutting blade against the central hub 140 thereby allowing each blade to pivot or rock during the cutting of a pizza.

The shaft 174 supports the compression spring 178 located beneath the collar 180 and above the central hub 140. The shaft 174 may be integral with the connector flange 176 which is received by the inner opening 214 of the mounted cutting blades. The integral washer portion 177, FIGS. 10 and 13, bears against the upper edges 204 of the cutting blades. The elastic band connector 182 is received by the outer opening 208 of the cutting blades so as to trap or restrain the cutting blades relative to the central hub 140 between the connector flange 176 and the washer 177 of the shaft 174 on the one side and the band connector 182 on the other side. This arrangement is also a feature and advantage of the pizza cutting apparatus 10.

All of the cutting blades and blade guards are identically structured and connected as described for the cutting blade 154 and the blade guard 170. The blade structure is relatively simple and easily made, the connector is also simple so that the whole cutting assembly is an elegant solution to problems of the prior art.

Figure 18:
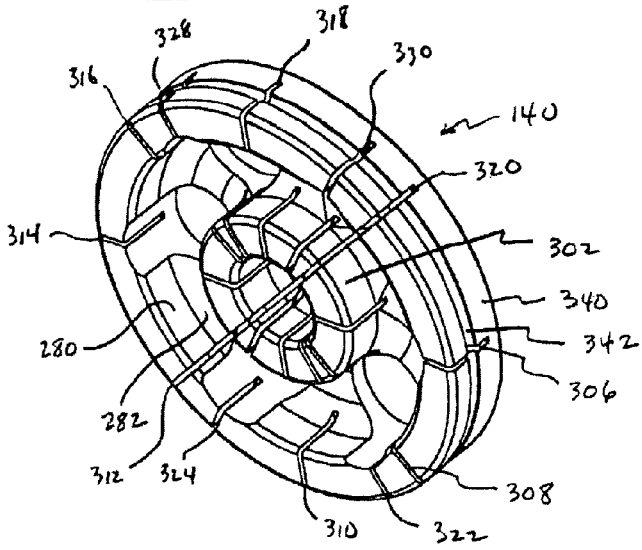
FIG. 18 is an upward looking isometric view of a central hub of the cutting assembly.
Figure 19:
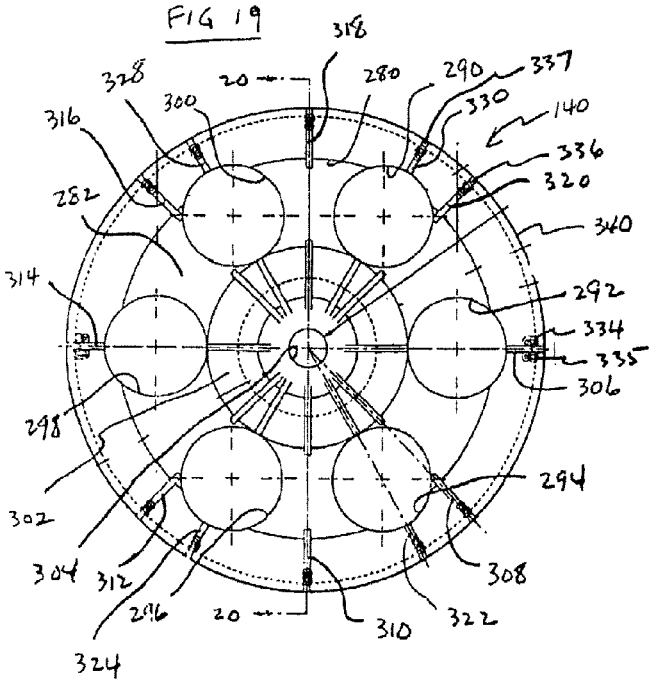
FIG. 19 is a bottom plan view of the central hub.
Figure 20:
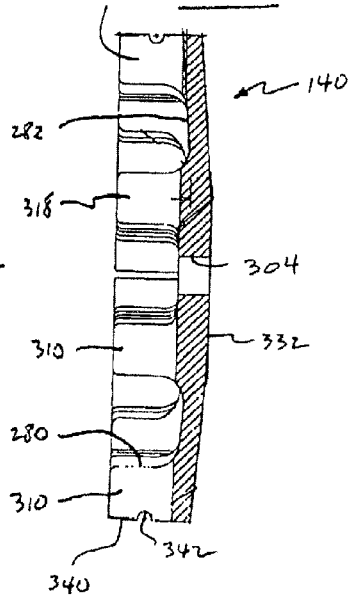
FIG. 20 is a sectional view taken along line 20-20 of FIG. 19.

The central hub 140, FIGS. 18-20 includes inner surfaces, such as a vertically oriented ring surface 280, and a horizontally oriented disk surface 282. Portions of the disk surface 282 engage the curved surfaces 212 of the upper edges 204 of the cutting blades. The central hub also includes a series of openings 290, 292, 294, 296, 298, 300, an inner core 302 and a central opening 304. The central opening 304 receives the shaft 174. Spaced at forty-five degree intervals is a first series of eight interrupted slots 306, 308, 310, 312, 314, 316, 318, 320 to receive the eight cutting blades. Formed sixty degrees apart is a second series of six interrupted slots 306, 322, 324, 314, 328, 330 (proceeding in a clockwise direction and overlapping to some extent the first series of slots) for receiving an arrangement of six cutting blades. These two arrangements allow the hub 140 to support four, six or eight evenly spaced cutting blades depending upon the number or size of pizza slices desired. If the pizza is to be divided into eight pieces then each of the eight slots spaced from one another at forty-five degrees supports a cutting blade. If the pizza is to be cut into four pieces, four cutting blades are placed in every other one of the slots spaced forty-five degrees apart resulting in a ninety degrees spacing between blades. If it is desired to slice a pizza into six pieces, then the six slots spaced from one another by sixty degrees are used to support six cutting blades.

It is noted that any arrangement of slots may be formed in a central hub as a function of the geometric shape of the pizza to be cut, of the desired geometric shape of the pizza pieces, and of the number of slices to be made.

To help an operator realign cutting blades between the eight blade arrangement and the six blade arrangement, the central hub may have a series of numbers formed in the top surface 332, FIG. 20. The numbers are viewable in FIG. 19. For example, above the slot 306 there are the number "6" at 334 and the number "8" at 335, indicating that the same slot 306 is used to receive a cutting blade regardless of the arrangement of cutting blades. In comparison, the slot 320 is labeled just with the number "8" at 336 and the slot 330 is labeled just with the number "6" at 337. These slots are filled only if the indicated arrangement, six or eight blades, is being used. It is noted that each of the other slots is also appropriately labeled in the same manner. As will be explained below, by rotating the pizza peel 20, a pizza may also be sliced into twelve or sixteen pieces.

The openings 290, 292, 294, 296, 298, 300 in the central hub offer another advantage of the apparatus in that the openings enable the hub to be easily gripped and held by an operator. The openings also enable an operator to view the blades and determine whether the blades should be cleaned.

The central hub 140 also includes an outer side wall 340 in which is formed a circumferential groove 342. The elastic band connector 182 not only engages the first set of openings 208 of the cutting blades, but the elastic band also engages the circumferential groove 342 as to form an easy and elegant restraining device for the cutting blades. The structure of the hub enables ease of handling, lower weight and facilitates the insertion and removal of the blade and guard combinations.

It is noted that the central hub need not be circular. Other geometric shapes may be used. Any suitable material may be used for the hub and the elastic band, such as the plastic acetal for the hub, and the plastic polyurethane for the band.

Figure 10:
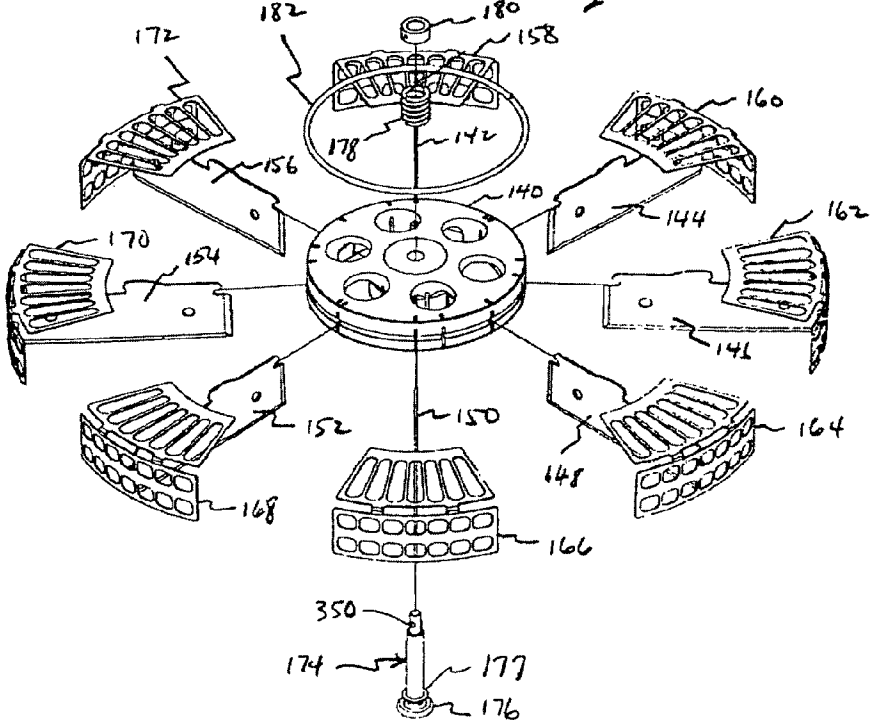
FIG. 10 is an exploded isometric view of a cutting assembly of the pizza cutting apparatus.
Figure 12:
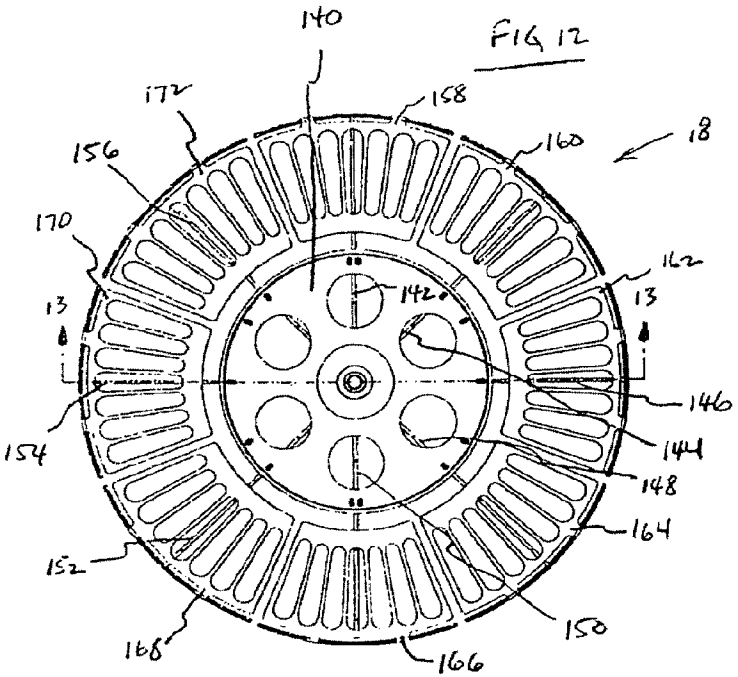
FIG. 12 is a top plan view of the cutting assembly.
Figure 11:
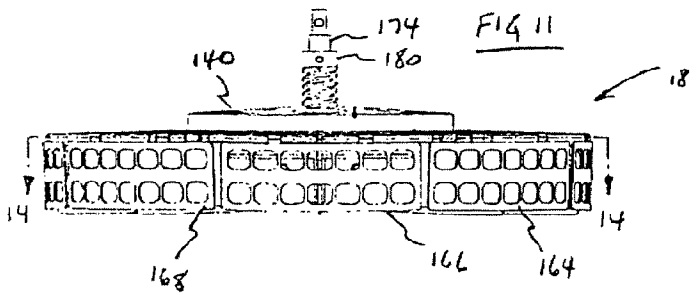
FIG. 11 is an elevation view of the cutting assembly.

The shaft 174 of the cutting assembly 18 includes a hole 350, FIGS. 10 and 13, located above the collar 180. The shaft 174 is received by the plunger 90 of the actuator assembly. The plunger also includes a hole 352, FIG. 8, that is alignable with the hole of the shaft. A quick release pin and ring combination 354, FIGS. 1, 2 and 8, may be inserted into the aligned holes to connect the plunger and the shaft thereby connecting the cutting assembly to the frame assembly. Adjusting the compression of the spring 94 counterbalances the weight of the cutting assembly 18 and eases the operation of rotating the level 22 through an arc of about one hundred and thirty degrees.

Figure 21:
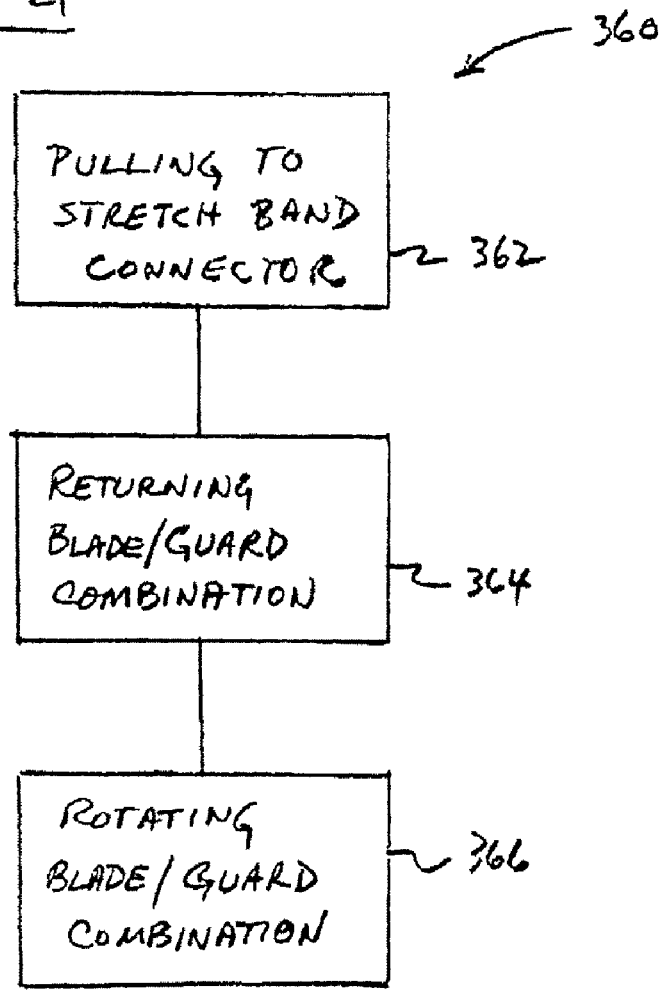
FIG. 21 is a flow chart illustrating the method of disassembly of the blade and guard combinations from the central hub.

The simple but elegant structure of the cutting assembly 18 allows the assembly to be easily taken apart for cleaning purposes or for changing the number of cutting blades to be used. The cutting assembly may then be easily reassembled in a minimum amount of time and with little danger to an operator. The method 360, FIG. 21, for disassembling the cutting apparatus includes stretching 362 the elastic band by pulling the blade guard/cutting blade combination laterally away from the shaft 174, while the cutting assembly 18 may be disposed of in its normal operating position, namely, with the lower beveled edges 200 oriented downwardly. Pulling the blade guard/cutting blade combination also removes the inner opening 214 from contact with the shaft flange connector 176. Thereafter, the blade guard/cutting blade combination is allowed to return 364, while it is also rotated 366 about the elastic band connection 182, the outer edge 206 of the cutting blade moving upwardly and the inner edge 202 of the cutting blade moving downwardly. This enables the outer opening 208 of the cutting blade to slip out of contact and engagement with the elastic band 182, thereby freeing the blade guard/cutting blade combination from the central hub 140 and the elastic band 182. During this simple manipulation, the elastic band remains engaged with the groove 342 of the central hub.

The method is quick, easy and safe because the cutting assembly is maintained in an upright position as depicted in FIG. 1. There is no need to invert the cutting assembly.

The arrangement of a blade guard attached directly to each cutting blade is a feature of the invention enabling the cutting blades to be handled easily, quickly and safely without unnecessarily exposing the operator to the lower beveled edges of the cutting blades. Each of the blade guard/cutting blade combinations may then be placed in a dishwasher. The shaft, the spring, the collar, the central hub and the band may also be easily separated and placed in a dishwasher if desired.

Re-assembly of the cutting apparatus is also quick, easy and safe and is also a feature of the pizza cutting apparatus 10. The shaft 174, the spring 178, the collar 180 and the band 182 are assembled on the central hub 140 and thereafter each of the cutting blades is reinserted into the appropriate slot of the central hub 140 so as to engage the elastic band 182. The band 182 is stretched by the cutting blade, the blade is rotated and the connector flange 176 is engaged. An alternative method is to have the blade engage the connector flange 176 first. Then the blade is rotated upwardly to engage the elastic band 182 by stretching it slightly using a portion of the curved surface 212. Once the outer opening 208 is aligned with the elastic band 182, the band 182 will snap back into the outer opening 208 to secure the blade guard/cutting blade combination in the cutting assembly.

Figure 22:
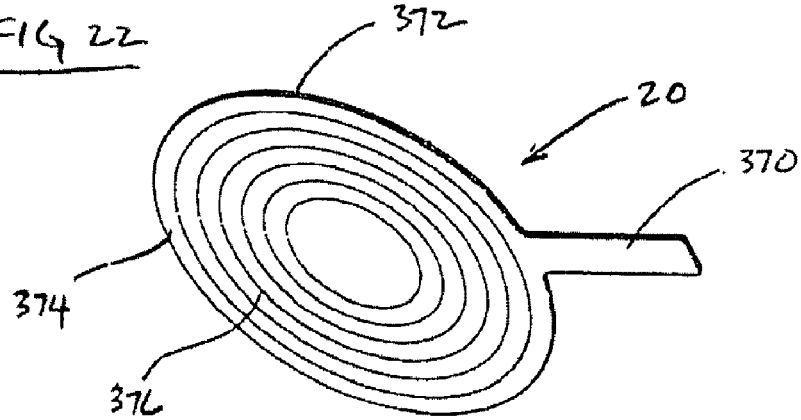
FIG. 22 is an isometric view of a pizza peel useful as part of the pizza cutting apparatus.

Referring now to FIG. 22, the pizza peel 20 is shown in more detail. The pizza peel includes a handle portion 370 and a platter portion 372. Formed on the top surface 374 of the platter portion 372 is a concentric series of circles 376 that may be etched by a laser. The circles act as guides for an operator to help properly locate a pizza on the peel as a function of pizza size.

Once a pizza is centered on an appropriate circle, the pizza peel is then located on the plate 14 by use of four locating pins of which two pins 380, 382, FIG. 1, are viewable. Thus, an operator can be assured of proper pizza alignment on the pizza cutting apparatus 10 by locating a pizza on the peel according to the concentric circles 376 and then by locating the peel in relation to the plate and thereby the cutting assembly mounted above the plate. These simple and easy location techniques ensure proper slicing of the pizza and equal size slices.

Another locating technique is in the form of two additional pins 390, 392 and two additional openings 394, 396 which may be used to relocate the pins 390, 392. Rotating the handle portion 370 of the peel enables the cutting assembly to double the number of slices from six to twelve or from eight to sixteen depending upon the blade arrangement being used. For example, using an eight blade arrangement as shown in FIGS. 1-4 and locating the handle portion 370 against the pin 392, depressing the lever 22 results in eight slices. Thereafter, rotating the pizza peel by placing the handle portion against the pin 390 and then depressing the lever results in another eight cuts or a total of sixteen pizza pieces. Moving the pins 390, 392 into the openings 394, 396 enables doubling the number of pizza slices from six to twelve when the six blade arrangement is used.

In operation the pizza cutting apparatus may be placed on a countertop in a pizzeria. A freshly cooked pizza is removed from an oven on a pizza peel 20 and is placed on the support plate 14 under the cutting assembly 18. An operator then grips the lever 22 of the actuator assembly, rotates the lever through approximately one hundred and thirty degrees causing the plunger 90 to push the cutting assembly 18 downwardly onto the pizza. As the cutting assembly is lowered, the cutting blades contact the outer periphery or edge of the pizza and with a rocking or pivoting motion is lowered into the central portion of the pizza. This allows the pizza to be cleanly and neatly severed into the desired number of slices.

The above specification describes in detail a preferred embodiment of the present invention. Other examples, embodiments, modifications and variations will under both the literal claim language and the doctrine of equivalents, come within the scope of the invention defined by the appended claims. For example, changing the shapes of the frame assembly elements or the shapes or structure of the cutting blades and the blade guards are all considered equivalent structures and will also come within the literal language of the claims. Still other alternatives will also be equivalent as well as many new technologies. There is no desire or intention here to limit in any way the application of the doctrine of equivalents nor to limit or restrict the scope of the invention as defined by the Claims that follow.

The invention claimed is:

1. A pizza cutting apparatus comprising:

a plurality of pizza cutting blades, each blade having a laterally extending cutting edge;

a support structure supporting the blades in cutting positions;

an actuator assembly operatively connected to the support structure, the actuator assembly configured to press the support structure and the blades downward such that the cutting edges are pressed into cutting engagement with a pizza; and an elastically deflectable connector engaging the blades in a deflected condition of the connector such that the connector applies a lateral restraining force urging the blades into abutment with the support structure in their cutting positions, wherein the blades are each movable relative to the support structure to subsequent cutting positions by movement of the blades during cutting.

2. An apparatus as defined in claim 1 wherein the connector is stretched when in the deflected condition.

3. An apparatus as defined in claim 2 wherein the connector is an elastic band.

4. An apparatus as defined in claim 3 wherein each blade has a notch in which the elastic band is received in the stretched condition and from which the elastic band is removable by further stretching.

5. An apparatus as defined in claim 4 wherein the notch is configured for the elastic band to be removed by rotating the cutting blade relative to the support structure.

6. An apparatus as defined in claim 1 wherein the blades and the support structure are configured such that the movement of the blades during cutting is a pivoting of the blades relative to the support structure when pressed downward into cutting engagement with a pizza.

7. An apparatus as defined in claim 1 wherein the support structure is configured to support the blades in cutting positions projecting radially over a pizza.

8. An apparatus as defined in claim 7 wherein the connector is configured to apply the restraining force radially inward.

9. An apparatus as defined in claim 1 wherein the support structure is configured to receive end portions of the cutting blades in abutment under the restraining force of the connector.

10. An apparatus as defined in claim 1 wherein the support structure has an array of slots in which the blades are receivable in their cutting positions.

11. An apparatus as defined in claim 10 wherein the cutting positions project radially from a common center and the array of slots is circular.

12. An apparatus as defined in claim 11 wherein the slots define a first series of cutting positions that are equally spaced-apart at first intervals and a second series of cutting positions that are equally spaced-apart at second intervals greater than the first intervals.

13. An apparatus as defined in claim 12 wherein the first intervals are forty-five degree intervals and the second intervals are sixty degree intervals.

14. An apparatus as defined in claim 1 wherein the connector is an elastic band that is stretched when in the deflected condition, and the support structure includes a band-retaining feature that is interposed between the cutting positions to receive the elastic band in the stretched condition such that each blade can be withdrawn from its cutting position by stretching the elastic band away from the band-retaining feature.

15. An apparatus as defined in claim 14 wherein the band-retaining feature is a groove extending around the support structure.

16. An apparatus as defined in claim 15 wherein the support structure includes a hub and the groove extends about the periphery of the hub.

17. An apparatus as defined in claim 16 wherein the hub is circular.

* * * * *